United States Patent [19]

Port

[11] 4,011,665

[45] Mar. 15, 1977

[54] DEVICE FOR PROVIDING A SEMI-PERMANENT LUMINESCENT DISPLAY

[76] Inventor: Lillian Port, 532 10th St., Brooklyn, N.Y. 11215

[22] Filed: Nov. 2, 1973

[21] Appl. No.: 412,186

[52] U.S. Cl. ..... 35/66

[51] Int. Cl.[2] ..... B43L 1/12

[58] Field of Search ..... 35/66, 61, 62; 161/6; 240/6.4 B, 2.25; 346/21

[56] References Cited

UNITED STATES PATENTS

| | | | |
|---|---|---|---|
| 1,631,192 | 6/1927 | Dunlap | 35/66 |
| 2,393,228 | 1/1946 | Blitz | 35/66 |
| 2,676,818 | 4/1954 | Blumberg | 35/66 X |
| 3,152,406 | 10/1964 | Marques | 35/66 |
| 3,761,343 | 9/1973 | Kinberg | 35/66 X |

OTHER PUBLICATIONS

"Fluorescent Envelopes," article in Scientific American, Sept. 1944.

*Primary Examiner*—Harland S. Skogquist
*Attorney, Agent, or Firm*—Friedman, Goodman & Teitelbaum

[57] ABSTRACT

A device is described for providing a semi-permanent luminescent display which includes a first sheet of substantially transparent material provided with a luminescent dye in the form of a fluorescent dye dispersed therethrough. The first sheet of fluorescent material is provided with a smooth major surface which is disposed in opposition to a smooth surface of a second dispersive opaque sheet of material. The two sheets of material are coextensive with one another and one of these sheets is pliable to permit the selective application of pressure on portions thereof to cause the smooth surfaces to come into contact with one another and cause the same to adhere to each other in the regions of these selective portions. Such adherence disperses the light in the fluorescent sheet which impinges at said portions and results in a luminescent effect corresponding to the indicia or pattern impressed. Separation of the sheets from one another terminates the intimate contact at the adhered interface portions between the smooth surfaces and terminates the luminescent impression, pattern or image.

16 Claims, 9 Drawing Figures

FIG. 1
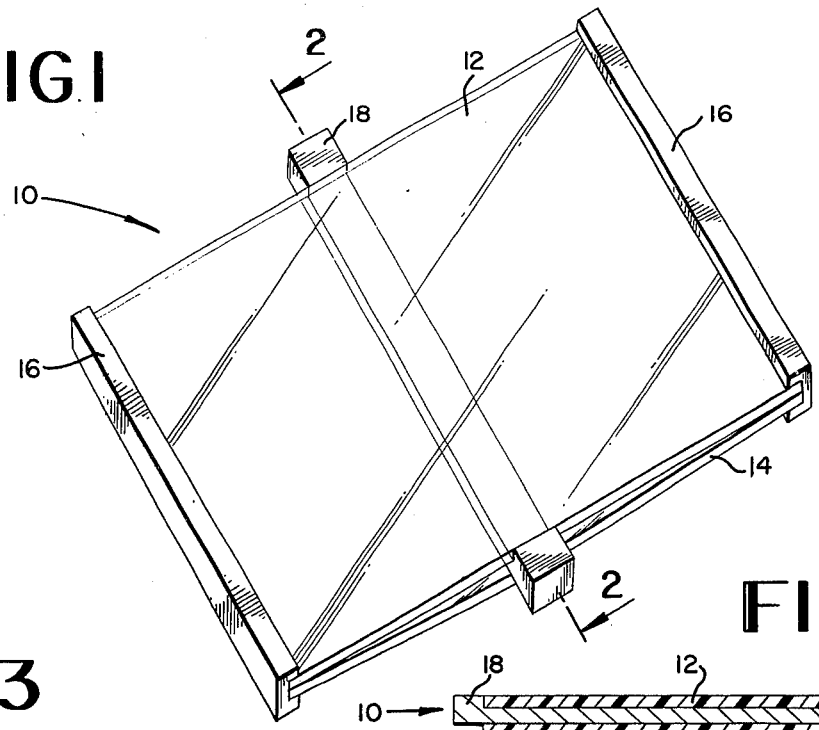
FIG. 2
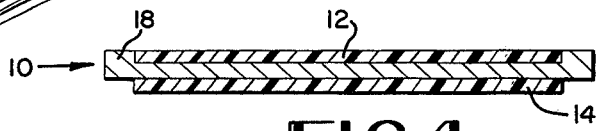
FIG. 3
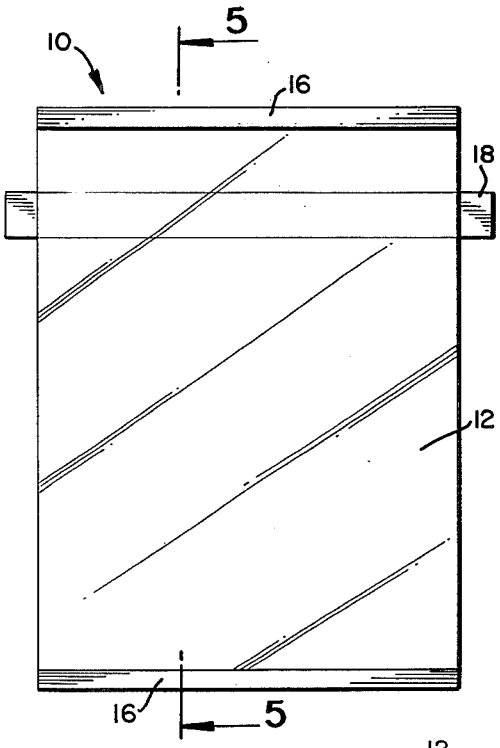
FIG. 4
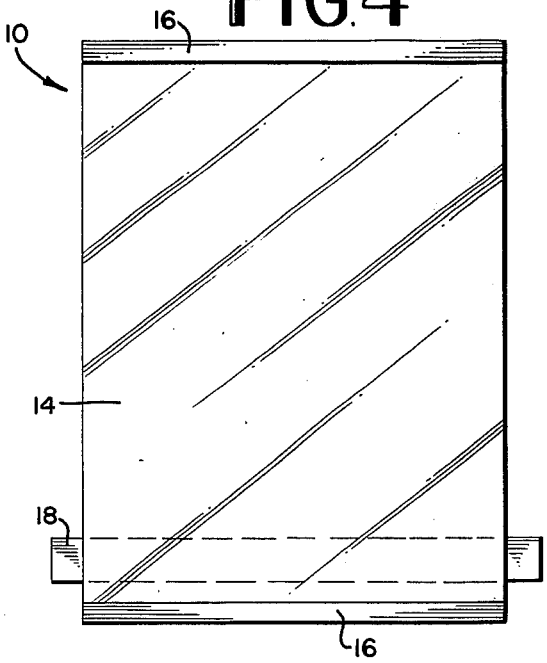
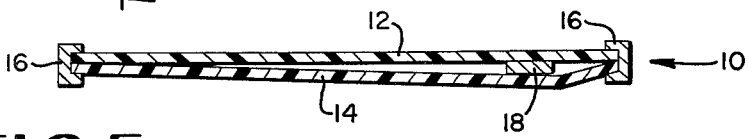
FIG. 5

DEVICE FOR PROVIDING A SEMI-PERMANENT LUMINESCENT DISPLAY

BACKGROUND OF THE INVENTION

This invention generally relates to display devices, and more particularly to a device providing a semi-permanent luminescent display.

Various types of display devices, including many toys, are in the form of writing pads or slates which are capable of exhibiting impressions formed thereon. These slates or writing pads have the advantageous feature that they may easily be erased to remove the impressions recorded thereon by separating a film or sheet from a paraffin coated surface which serves as a backing sheet. The film which is generally used for this purpose is a translucent sheet. Writing on the pad with application of requisite pressure causes an intimate contact between the translucent sheet and the paraffin coated backing to make the latter visible through the former. In this manner, impressions are recorded on the pad. However, this arrangement generally doesn't permit effective printing with rubber stamps or the like since the requisite pressures of the impressions are not achievable.

With the known constructions, the impressions recorded on the pad are generally dull. Further, the known pads generally had a short lifetime due to the weak nature of the translucent sheet used therewith. The translucent sheet used is generally brittle and becomes soiled and creased with extended use. One proposed way of prolonging the inclusion of a pliable protective plastic sheet over the translucent sheet. This has had a disadvantage, however in that the lines formed by the modified writing pad generally tend to be thicker due to the application of pressure indirectly to the plastic sheet and not directly to the translucent sheet.

Other forms of toys or recording devices are known which are substantially more complex in construction than the pad described above. These further known recording devices do not provide a luminescent display which uses a fluorescent sheet of material to provide a simple and inexpensive device which provides a fluorescent display at the points where impressions are formed thereon.

SUMMARY OF THE INVENTION

Accordingly, it is an object of the present invention to provide a luminescent display device which is not possessed of the disadvantages described above in connection with comparable prior art devices.

It is another object of the present invention to provide a luminescent display device which is simple in construction and economical to manufacture.

It is still another object of the present invention to provide a luminescent display device which can utilize a solid or a rigid luminescent sheet of plastic material.

It is yet another object of the present invention to provide a display device which provides brilliant fluorescent images or impressions when these are formed on the device.

It is a further object of the present invention to provide a fluorescent display device which includes movable means for removing the fluorescent impressions formed thereon.

In order to achieve the above objects, as well as others which will become apparent hereafter, the device of the present invention for providing a semi-permanent luminescent display comprises a first sheet of substantially transparent material provided with a luminescent dye dispersed therethrough. Said first sheet is provided with at least one smooth or substantially mirror-like finish major surface. A second dispersive sheet of material which has at least one smooth major surface is disposed adjacent to and coextensive with said first sheet to position said respective smooth surfaces of said sheets in opposition to each other. At least one of said sheets is pliable to permit selective application of pressure on portions thereof to cause said smooth surfaces to come into intimate contact with one another and to cause the same to adhere to each other in the regions of said selected portions to disperse the light in said first sheet which impinges at said portions and to result in a luminescent effect corresponding to the indicia or other markings impressed thereon. Such sheets are separable from one another to terminate the intimate contact at the interface between said smooth surfaces at the selected portions and terminate the luminescent effect. The present invention contemplates devices of the type above described wherein both of said sheets or only one of said sheets is pliable.

BRIEF DESCRIPTION OF THE DRAWINGS

With the above and additional objects and advantages in view, as will hereinafter appear, this invention comprises the devices, combinations and arrangements of parts hereinafter described and illustrated in the accompanying drawings of a preferred embodiment in which:

FIG. 1 is a perspective view of a fluorescent display device in accordance with the present invention;

FIG. 2 is a cross section of the display device shown in FIG. 1, taken along line 2—2;

FIG. 3 is a top plan view of the display device shown in FIG. 1;

FIG. 4 is a bottom plan view of the display device shown in FIG. 1;

FIG. 5 is a cross section of the display device shown in FIG. 3, taken along line 5—5;

DESCRIPTION OF THE PREFERRED EMBODIMENTS

Figure 6:
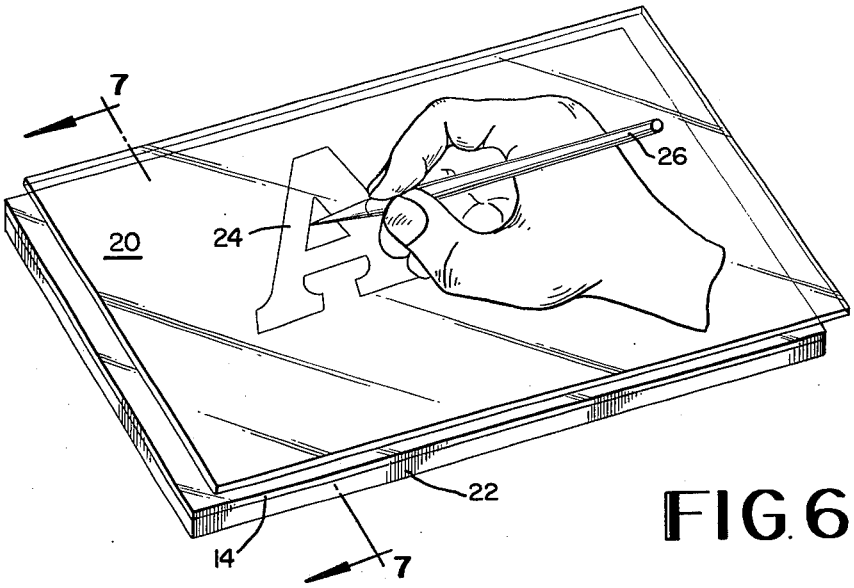
FIG. 6 is a perspective view of a further embodiment of the display device shown in FIG. 1, together with a backing sheet, showing the manner in which a fluorescent impression is formed.

Referring now to the drawings, in which the same reference numerals are utilized to designate the identical or similar parts throughout, and first referring to FIGS. 1–5, the display device of the present invention is generally designated by the reference numeral 10. Although only a few embodiments or variations of the invention are shown and described, it will become clear from the description that follows that many other variations of the basic principle here described are possible and these variations are similarly contemplated by the present invention.

The display device 10, in its general aspects, comprises a first sheet 12 and a second sheet 14 which are disposed adjacent to and coextensive with each other.

Each of the sheets 12, 14 includes a smooth or substantially mirror-like finish major surface which faces the other sheet. The characteristics of the plastic sheets 12, 14 will be more fully described below.

The sheets 12 and 14 are both shown to be rectangular and have common dimensions with the adjacent opposing edges thereof being held together by any suitable retaining means, such as tape. Clearly, however, any other suitable retaining means 16, such as metal or plastic clamps or channels may equally be used for this purpose.

As will be more fully described below, at least one of the sheets 12, 14 is pliable and movable relative to the other sheet. The sheets 12 and 14 can be effectively separated from one another by means of a separating bar in the form of a strip 18 which is movable between the two sheets. The elongate strip 18 is of generally rigid material and disposed between the sheets. The strip 18 advantageously has at least one free end thereof extending beyond the extent of the sheets to make the same accessible exteriorly for manipulating and moving the strip between the sheets.

The present invention differs from the prior art writing slates or pads in that the impressions which are formed thereon are luminescent or fluorescent and appear in a brilliant color. To achieve such a luminescent effect, the first sheet 12 is advantageously made from a substantially transparent material provided with a luminescent dye of any desired color dispersed therethrough. The term luminescence denotes an emission of light which is greater than could occur from temperature radiation alone. Photoluminescence, which is here under consideration, is the phenomenon of light emission in excess of thermal radiation. Photoluminescence depends upon excitation by light radiation in the shorter wavelengths of the light spectrum. For example, most luminescent dyes are responsive to invisible ultraviolet light which absorbs the latter and emits fluorescent light in the visible spectrum with a color characteristic of the particular dye used. Luminescent emission involves optical transitions between electronic states characteristic of the radiating substances. The light that is confined to the period of excitation is called fluorescence, and that which persists after excitation has ceased its termed phosphorescence, or after glow.

Luminescence is possible in both gases, liquids and solids. Of interest here is the luminescence of solids. Both organic materials and inorganic crystals exhibit luminescent characteristics. Of particular interest here are the luminescent organic materials which are aromatic molecules related to dyes. The sodium salt of fluorescein is well known as an efficient fluorescent material. Other organic substances luminesce efficiently when dissolves in organic solvents.

The luminescent or fluorescent sheets 12 is advantageously transparent and provided with a luminescent dye dispersed therethrough. While the sheet 12 may also be translucent, more brilliant displays are achievable when the fluorescent sheets are transparent. The sheet 12 may be pliable or rigid and may be in the form of any suitable elastomeric material such as a vinyl or acrylic plastic.

The sheet 14, on the other hand, is advantageously opaque and non-absorbent. The smooth surface of the sheet 14 which faces the sheet 12 is a dispersive surface which causes parallel light impinging thereon to be randomly dispersed in at different reflective angles.

Although both sheets 12, 14 may be non-rigid or pliable, at least one of these sheets must be pliable. When both sheets are pliable, a rigid backing sheet may be provided as to be described in connection with FIGS. 6–9.

As described above, the sheet 14 is both opaque and non-absorbent. Accordingly, the sheet 14 is advantageously of a bright or light color such as white. The use of non-absorbent colors increases the amount of light which is reflected through the fluorescent sheet 12 to enhance the brightness or brilliance of the impressed information. A presently preferred material for the sheet 14 is a white vinyl sheet. Where colored opaque dispersive sheets are used, it is preferable that both sheets 12 and 14 of the same color or close shades thereof. This is to prevent excessive absorption of each sheet of the color light associated with the other sheet. When both sheets are of the same color, the fluorescent sheet transmits the respective colored light and the opaque sheet reflects that same light with minimal absorption. Hence, such matching of colors of the sheets, particularly when darker, more absorbant colors are used, results in more brilliant displays of the impressions.

As described above, the two facing surfaces of the sheets 12 and 14 are advantageously smooth. In the case of vinyl sheets, the surfaces thereof have wetting characteristics. The term wetting as used herein is not technical but descriptive. Thus, the appearance of the sheets 12 and 14 when they are urged against one another in pressure relation appear to have a wet surface therebetween. Such a wetting characteristic causes the two facing surfaces of the two adjacent sheets to adhere to each other. The surfaces are advantageously smooth and pliable to the extent which permits adherence between the two sheets almost at the molecular level which causes all residual air therebetween to be forced out. The consequence of such an arrangement is the resulting change in the reflective characteristics of the interface between the two sheets. The wetting or adhesion effect here under discussion has been noted in the prior art and has been utilized to support opaque film cutouts such as letters or the like against glass or smooth synthetic plastic sheets. The opaque characteristic of the sheet 14 prevents light to pass therethrough while a non-absorbent sheet 14 causes the light to be reflected instead of dissipating the same. Vinyl, acetate, laminated cardboard or any other material may be utilized as sheet 14 as long as the same exhibits dispersive and wetting surface characteristics as described above.

The method of operation of the display device of the present invention and the principle of operation of the same will now be described in reference to FIGS. 6–9. In FIG. 6, a flexible or pliable fluorescent sheet 20 is disposed adjacent to and coextensive with a pliable opaque vinyl sheet 14. Because both sheets are pliable, a solid backing sheet 22 of any suitable material is provided which abuts against the sheet 14. When rays of light impinge upon the upper major surface of the fluorescent sheet 20, the major portion of this light is reflected in accordance with the law of reflection. Because of the small number of fluorescent molecules available at the top surface of the sheet 20, the resulting fluorescent effect across the entire surface area of the sheet 20 will be limited. The portion of the incident light on the sheet 20 which is not reflected in accordance with the law of reflection but is refracted into the sheet 20 impinges on the lower smooth surface of the sheet 20 and continues to rebound within the fluorescent sheet 20 until the same exists at the edges thereof. This is caused by the presence of a space, gap or air layer 32 which results in an angle of reflection at the lower surface of the sheet 20 facing the sheet 14 greater than the critical angle. Furthermore, the smooth surface of the fluorescent sheet 20 which faces the opaque sheet 14 is smooth, as described above, and reflection takes place at this surface in accordance with the optical law of reflection.

Figure 8:
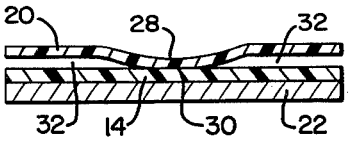
FIG. 8 is similar to FIG. 7, showing the relationship of the sheets when an impression is formed.

When a pointed or blunt instrument 26 is utilized to apply pressure upon the fluorescent sheet 20 and cause the latter to abut against the opaque sheet 14 to form any desired impression 24, the fluorescent sheet is deflected or depressed as shown at 28 in FIG. 8. It should be clear that any other means for forming a depression, such as a rubber stamp, may be utilized to impress a line or a complete figure on the sheets. Sufficient pressure by the instrument 26 must be applied to substantially reduce the gap or space 32 to zero distance and thereby expel the air layer along the portion which has been selected for making an impression. The pressure applied to the fluorescent sheet 20 causes the latter to come into intimate contact with the opaque sheet 14 at the portions where such depression has taken place and the appearance of wetting results from the adhesion, almost at the molecular level, between the two smooth surfaces of the sheets 20 and 14 such as at 30. The effect of such adhesion or very intimate contact at the selected portions which have been depressed is to modify the reflective properties of the fluorescent sheet 20 at its lower surface thereof or instance with the sheet 14. Whereas the presence of an air layer 32 causes rays of light within the sheet 20 to undergo multiple reflections due to the smooth lower surface thereof, the reflective properties at the adhesion point 30 essentially become those of the upper smooth diffractive surface of the sheet 14 which faces the fluorescent sheet 20. It is for this reason that the sheet 14 is advantageously opaque and non-absorbent. In the presently preferred embodiment, the sheet 14 serves to provide dispersive surfaces at the selected portions which have been depressed at the adhesion points 30. The dispersive characteristic of the opaque sheet 14 prevents the light from undergoing multiple reflections since the dispersive opaque sheet 14 disperses the rays of light which impinge thereupon at arbitrary or random angles, many of these which are smaller than the critical angle. Those rays of light which are reflected from the dispersive sheet 14 at angles less than the critical angle will escape the confines of the fluorescent sheet 20 and will emanate through the top surface thereof. The light rays which so emanate through the top surface of the sheet 20 includes luminescent, or in the preferred embodiment fluorescent, light. Now, because the dye molcules extending throughout the entire thickness of the fluorescent sheet 20 come into play and serve as sources of fluorescent light, the light which is visible at the depressed point 30 becomes substantially more brilliant compared with the luminescent light emitted solely by the top surface of the fluorescent sheet. In this manner, the depressed portions 28 of an impression 24 stand out compared to the remainder of the sheet 20 which has not been depressed. The effect is apparent but transient if there is little wetting and adhesion and results from the temporary instantaneous pressures applied to the sheets.

Figure 7:
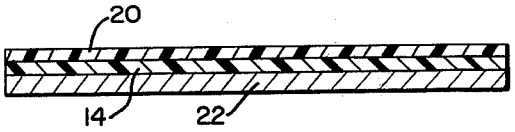
FIG. 7 is a cross section of the display device shown in FIG. 6, taken along line 7—7.

In FIG. 7, the sheets 14 and 20 are shown in intimate contact along the entire extent thereof. Accordingly, the fluorescent effect will take place and be visible along the entire extent thereof, similarly as described in connection of the portion 28 in FIG. 8.

Figure 9:
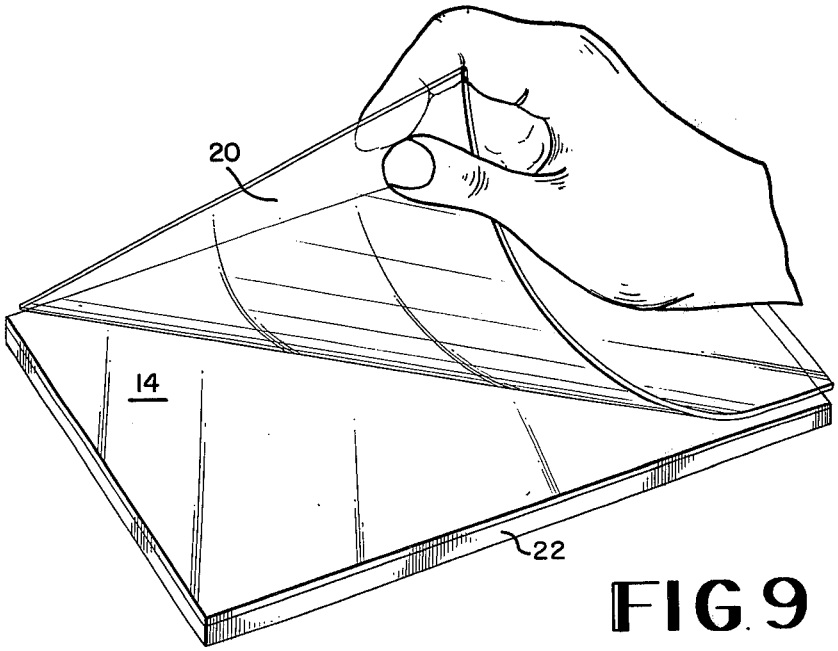
FIG. 9 is similar to FIG. 6, showing the manner in which an impression is erased.

In FIG. 9, the sheet 20 is shown being peeled off with the respect to the sheet 14. The separation of the sheets from one another in this manner terminates the adhesive contacts 30 therebetween at the interfaces thereof to restore the air spaces or gaps 32 and consequently terminate the luminescent effect. The pad is now again ready to be depressed along selected portions thereof by the instrument 26 to form a new impression 24 thereon. Therefore, separation of the sheets essentially erases the information which has been written thereon. In this connection, reference is had to FIGS. 1–5 wherein a separating bar or strip 18 is utilized to erase the recorded information by terminating the adhesion points 30 between the interfacing surfaces. The strip 18 acts as a separating means which is movable between the two sheets. The strip 18 is advantageously made from a rigid material which is disposed between the sheets and has at least one free end thereof extending beyond the extent of the sheets to make the free end accessible for manipulating and moving the strip between the sheets 12 and 14. As best depicted in FIGS. 2 and 5, transverse movement of the strip 18 from one retaining means 16 to the other successively separates these sheets along the width thereof, simultaneously destroying the adhesive contact point 30 to thereby erase whatever impressions had been formed on the display device or writing pad 10. Instead of a rigid strip, a pliable string may also be used. Alternately, with the sheets 12 and 14 joined at a peripheral seam (not shown), air can be introduced between the sheets to cause the same to separate.

In one presently preferred embodiment, shown in FIGS. 1–5, the upper fluorescent sheet 12 is rigid and the lower opaque sheet is pliable. With such a device, pressure is applied from below the pliable opaque sheet 14 with the upper fluorescent sheet functioning as a backing sheet. This results in a luminescent display when viewing the device above the fluorescent sheet. However, it is equally possible to make the opaque sheet rigid with the upper fluorescent sheet being pliable. In this case, the writing or depression is formed in the upper fluorescent sheet with the lower rigid opaque sheet functioning as a backing sheet. Again, the luminescent display is observed above the fluorescent sheet. A still further variation is where both the fluorescent and opaque sheets are pliable. This last embodiment is illustrated in FIGS. 6–9. With such an arrangement, a rigid backing sheet 22 is advantageously provided which is disposed adjacent to and coextensive with the opaque sheet 14 to provide a rigid support for facilitating the application of pressure as described above to form the depressions 28. Again, the luminescent display is observed when viewing the top fluorescent sheet 20.

The wetting characteristic is believed to result from the addition of plasticizers to the sheets. For example, the sheets which have been found satisfactory for this purpose have been plasticized polyvinyl chloride sheets. The ability of the sheets to adhere to each other is important not only for the purpose of generating the requisite dispersive regions or portions above described, but for maintaining the resulting display for an extended period of time. Clearly, it is desired that once adhesion has taken place at the depression points that such adhesion state be maintainable for an extended period of time to prevent the display or impression from self erasing itself. For this reason, the pliable sheet is advantageously not too rigid but relatively pliable to prevent the restoration or reversion of the deformed sheet to its initial planar or flat condition. Such reversion which eliminates or terminates the adhesion points causes the fluorescent display to become prematurely erased.

The above described display device 10 can also be utilized in the dark in the presence of a "black light" or light radiation in the invisible portion of the spectrum. Ultraviolet lamps are one example of possible sources which can be used for this purpose. As with visible light, the fluorescent dye molecules absorb the black light and emit the visible fluorescent light. Consequently, it is important that the dye material react or respond to the range of frequencies which the black light source is emitting. Hence, the device has special utility under circumstances where it is desired to provide written indicia or the like in a dark area. It may thus be readily used in conjunction with lectures in a dark lecture hall or other circumstances where extraneous visible light is not available or desired. Other possible applications include use in photography darkrooms, night military use and use in connection with toys and magic tricks.

Small levels of utraviolet light are usually available in the atmosphere and theses levels may be sufficient to activate the fluorescent dyes in the display device 10. However, the provision of a black light source enhances the radiation levels for exciting the die molecules and the amount of fluorescent light emitted becomes greatly enhanced. Accordingly, the present invention contemplates a display device, in the nature of writing pad or a larger blackboard-like device, in combination with a source of suitable black light which emits the requisite radiation towards the display device. Such an arrangement may be readily used in the presence or absence of visible light.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A display device for providing a semi-permanent luminescent display comprising a first sheet of substantially transparent material provided with a fluorescent dye dispersed therethrough and provided with at least one smooth major surface; a dispersive second sheet of material having at least one smooth major surface disposed adjacent to and coextensive with said first sheet to position said respective smooth surfaces of said sheets in opposition to each other, at least one of said sheets being pliable to permit the selective application of pressure on portions thereof to cause said smooth surfaces to come into intimate contact with one another and to cause the same to adhere to each other in the regions of said selected portions to disperse the light which impinges at said portions and to result in a luminescent effect, said sheets being separable from one another to terminate the intimate contact at the interface between said smooth surfaces at the selected portions and terminate the luminescent effect.

2. A display device as defined in claim 1, wherein said first sheet is rigid and said second sheet is pliable, whereby application of pressure on said second sheet with said first sheet functioning as a backing sheet results in a luminescent display when viewing said first sheet.

3. A display device as defined in claim 1, wherein both said sheets are pliable.

4. A display device as defined in claim 1, wherein said first sheet is made from an elastomeric plastic material.

5. A display device as defined in claim 4, wherein said material is a vinyl material.

6. A display device as defined in claim 4, wherein said material is an acrylic plastic.

7. A display device as defined in claim 1, wherein at least one of said sheets has a wetting characteristic at this smooth surface thereof which causes the same to adhere to a smooth contacting surface when urged thereagainst.

8. A display device as defined in claim 1, wherein said second sheet is substantially non-absorbent.

9. A display device as defined in claim 1, wherein said second sheet is opaque.

10. A display device as defined in claim 1, wherein said second sheet has a smooth optically dispersive surface.

11. A display device as defined in claim 1, wherein said first sheet is pliable and said second sheet is rigid, whereby application of pressure on said first sheet with said second sheet functioning as a backing sheet results in a luminescent display when viewing said first sheet.

12. A display device as defined in claim 1, wherein both said sheets are pliable, and further comprising a rigid backing sheet disposed adjacently to and coextensively with said second sheet, whereby application of pressure on said first sheet results in a luminescent display when viewing the same.

13. A display device as defined in claim 1, further comprising separating means movable between said two sheets for terminating the adhesion therebetween and the luminescent effect resulting therefrom.

14. A display device as defined in claim 13, wherein said separating means comprises an elongate strip of rigid material disposed between said sheets and having at least on free end thereof extending beyond the extent of said sheets to make said free end accessible for manipulating said strip.

15. A display device as defined in claim 1, in combination with a source of black light which emits invisible radiation to which said luminescent dye is responsive.

16. A display device as defined in claim 15, wherein said source of black light comprises an ultraviolet lamp.

* * * * *